US010288345B2

(12) United States Patent
Qiu et al.

(10) Patent No.: US 10,288,345 B2
(45) Date of Patent: May 14, 2019

(54) WATER COOLED DRAFT BEER MACHINE

(71) Applicants: Diqing Qiu, Taizhou (CN); Dilin Qiu, Taizhou (CN)

(72) Inventors: Diqing Qiu, Taizhou (CN); Dilin Qiu, Taizhou (CN)

(73) Assignee: Diqing Qiu, Taizhou (CN)

( * ) Notice: Subject to any disclaimer, the term of this patent is extended or adjusted under 35 U.S.C. 154(b) by 155 days.

(21) Appl. No.: 15/418,679

(22) Filed: Jan. 28, 2017

(65) Prior Publication Data

US 2018/0100693 A1 Apr. 12, 2018

(30) Foreign Application Priority Data

Oct. 11, 2016 (CN) ..... 2016 1 0887398

(51) Int. Cl.

| | |
|---|---|
| ***B67D 1/00*** | (2006.01) |
| ***B67D 1/08*** | (2006.01) |
| ***F25D 11/00*** | (2006.01) |
| ***F25D 17/02*** | (2006.01) |
| ***F25D 31/00*** | (2006.01) |

(52) U.S. Cl.

CPC ..... *F25D 31/002* (2013.01); *B67D 1/0004* (2013.01); *B67D 1/0864* (2013.01); *B67D 1/0867* (2013.01); *B67D 1/0891* (2013.01); *F25D 11/00* (2013.01); *F25D 17/02* (2013.01); *F25D 31/006* (2013.01); *B67D 2001/0089* (2013.01); *B67D 2210/00031* (2013.01);

(Continued)

(58) Field of Classification Search

CPC ..... F25D 31/002; F25D 11/00; F25D 17/02; B67D 1/004; B67D 1/0864; B67D 1/0867; B67D 1/0891; B67D 2210/00031

See application file for complete search history.

(56) References Cited

U.S. PATENT DOCUMENTS 2,325,228 A * 7/1943 Cornelius ..... B67D 1/06 137/338
5,974,824 A * 11/1999 Galockin ..... B67D 1/0864 222/146.6

(Continued)

FOREIGN PATENT DOCUMENTS

CN 2189301 Y 2/1995
CN 2306223 Y 2/1999

(Continued)

*Primary Examiner* — Elizabeth J Martin

(74) *Attorney, Agent, or Firm* — Minder Law Group; Willy H. Wong

(57) ABSTRACT

A water cooled draft beer machine comprises a cabinet, and there is a refrigeration circuit inside the cabinet, including a compressor, a condenser and refrigeration tubes. A water tank is arranged inside the cabinet, and the refrigeration tubes are coiled inside the water tank. Inside the cabinet, there is a cold storage chamber. A beer pipe is arranged inside the cabinet, and a beer tap is connected to the outside of the cabinet. The beer pipe coils inside the water tank, and is connected to the beer tap. A refrigeration box is arranged in the cold storage chamber, and the cold water tube coils inside the refrigeration box. The inlet end and the outlet end of the cold water tube are both connected to the water tank. An air inlet and an air outlet are set up on the refrigeration box. A fan is arranged inside the refrigeration box.

19 Claims, 12 Drawing Sheets

(52) U.S. Cl.
CPC ..... *B67D 2210/00133* (2013.01); *B67D 2210/00139* (2013.01); *F25D 2400/28* (2013.01)

(56) References Cited

U.S. PATENT DOCUMENTS

| | | | | |
|---|---|---|---|---|
| 6,438,989 | B1 * | 8/2002 | Wolski | B67D 1/0864 62/299 |
| 2011/0108240 | A1 * | 5/2011 | Bax | B67D 1/06 165/104.19 |

FOREIGN PATENT DOCUMENTS

| | | | |
|---|---|---|---|
| CN | 201322507 | Y | 10/2009 |
| JP | 2004106927 | A | 4/2004 |
| WO | WO2006103566 | A2 | 10/2006 |

* cited by examiner

WATER COOLED DRAFT BEER MACHINE

RELATED APPLICATIONS

This application claims benefit of Chinese Patent Application No. CN 201610887398.4, filed Oct. 11, 2016.

The applications and all patents, patent applications, articles, books, specifications, other publications, documents, and things referenced herein are hereby incorporated herein in their entirety for all purposes. To the extent of any inconsistency or conflict in the definition or use of a term between any of the incorporated publications, documents, or things and the text of the present document, the definition or use of the term in the present document shall prevail.

BACKGROUND OF THE INVENTION

Field of Invention

The present invention relates to the technical field of beverage equipment, and particularly to a water cooled draft beer machine.

Related Art

With the progress of the times, and the improvement of people's quality of life, people have a higher requirement for drinking beer. It has been difficult for canned or bottled beer to meet people's drink demand, and more and more people hope they could drink fresh, hygiene, palatable and pure draft beer. A draft beer machine is a device to cool the beer. Traditional draft beer machines are used in coordination with the carbon dioxide cylinder and casks. Beer at normal temperature is stored in the casks, and by applying the pressure from the carbon dioxide cylinder, the beer in the cask will be pressed out and flows into the draft beer machine. The draft beer machine will refrigerate the beer passing through it, and then beer flows out of the draft beer machine and arrives at the tap. People drink beer as soon as they open the tap.

One prior art device comprises a gas cylinder, a water purification device, a cleaning tank, a beer cask, a refrigeration system, a heat exchanger and a beer dispensing section. The gas cylinder is connected to the intake valve pipe of the cleaning tank, the gas cylinder is connected to the intake valve pipe of the beer cask, the water purification equipment is connected to the reversing valve pipe of the cleaning tank, and the reversing valve of the cleaning tank is connected to the reversing valve pipe of the beer cask. The reversing valve of the beer cask is connected to the heat exchanger pipe, the heat exchanger is connected to the pipe of the beer dispensing section, and the heat exchanger is placed inside the refrigeration system. This draft beer machine organically combines the cleaning management and refrigeration, and achieves refrigeration and cleaning quickly. This not only ensures the beer is cool, but also and more importantly ensures the freshness.

Although this draft beer machine can achieve the refrigeration of beer, it has the disadvantage of slow refrigeration speed. Specifically, this draft beer machine cools the water in the water tank by the compressor, and the beer pipe is located inside the water tank. Therefore, when beer passes through the beer pipe, it is refrigerated. Since beer in the cask was at a normal temperature originally, when it flows by the water tank quickly, it is hard for the water tank to refrigerate beer quickly. The refrigeration effect to beer is poor.

SUMMARY OF THE INVENTION

One objective of one embodiment of the present invention is to avoid the issues stated above in the prior art, and to provide a water cooled draft beer machine. The water cooled draft beer machine has a fairly good refrigeration effect.

One objective of one embodiment of the present invention can be achieved by the following technical proposal:

A water cooled draft beer machine comprises a cabinet, and there is a refrigeration circuit inside the cabinet, including a compressor, a condenser and refrigeration tubes. A water tank is arranged inside the cabinet, and the refrigeration tubes are coiled inside the water tank. Inside the cabinet, there is a cold storage chamber used to hold the cask. A beer pipe is arranged inside the cabinet to connect to the cask, and a beer tap is connected to the outside of the cabinet. The beer pipe coils inside the water tank, and the outlet end of the beer pipe is connected to the beer tap. It is characterized in that:

A refrigeration box is arranged in the cold storage chamber, and the cold water tube coils inside the refrigeration box. The inlet end and the outlet end of the cold water tube are both connected to the water tank. A power mechanism is arranged in the cabinet to drive water in the water tank to circulate in the cold water tube. An air inlet and an air outlet are set up on the refrigeration box, and both of the air inlet and the air outlet are connected to the cold storage chamber. A fan is arranged inside the refrigeration box to drive air to circulate between the refrigeration box and the cold storage chamber.

The cask is placed in the cold storage chamber. The inlet end of the beer pipe is connected to the cask, and the outlet end of the beer pipe is connected to the beer tap. When the beer tap opens, the beer in the cask will be pressed out. The cooling medium in the refrigeration circuit circulates in the refrigeration tubes. The refrigeration tubes coil in the water tank, have a fairly long running path, and can refrigerate the water in the water tank. The beer pipe is immersed in the water tank and coils with several turns, so beer will be refrigerated when it passes through the beer pipe in the water tank. Meanwhile, the power mechanism can make the cold water in the water tank circulate in the cold water tube, and the cold water tube coils in the refrigeration box, which also has a long running path. Therefore, the cold water tube can refrigerate the air in the refrigeration box. The fan can make the air circulate between the refrigeration box and the cold storage chamber. Namely, the cold air in the refrigeration box is blown into the cold storage chamber via the air outlet, and the air in the cold storage chamber will return to the refrigeration box via the air inlet, so the cold storage chamber has a fairly low ambient temperature and it refrigerates the whole cask. That means that the beer in the cask has been pre-cooled before it is pressed out, and then it is water cooled again by the water tank during the discharge process, so that the refrigeration effect to the beer is improved. Further, in order to achieve a fairly good refrigeration effect to the beer passing through the water tank, the water temperature in the water tank is fairly low. Also, by refrigerating the air in the refrigeration box with the cold water in the water tank, the cooling capacity of the cold water in the water tank is fully utilized.

In the water cooled draft beer machine, the power mechanism comprises a stirring motor fixed to the water tank. A volute is fixed to the inside of the water tank, and a water inlet and a water outlet are set up on the volute. An impeller is fixed to the motor shaft of stirring motor. The impeller is located in the volute and the impeller is opposite the water inlet. The inlet end of the cold water tube is connected to the water outlet of the volute, and the stirring blades are also connected to the motor shaft of the stirring motor. The stirring motor stirs water in the water tank with the stirring blades, in order to avoid the freezing of the water in the water tank. The volute and the impeller are both immersed in the water. The motor shaft of the stirring motor drives the impeller to rotate, and the impeller can pump cold water from the water tank into the volute and make it circulate in the cold water tube. The cold water enters the water tank again after passing by the refrigeration box. This forms a circulation of water, ensures the refrigeration of the air in the refrigeration box. Hence this ensures that the cold storage chamber maintains a fairly low ambient temperature, and improves the refrigeration effect.

In the water cooled draft beer machine, the power mechanism comprises a water pump fixed to the inside of the water tank, and the cold water tube is connected to the water pump. The stirring motor is also fixed to the inside of the water tank, and the stirring blades are also arranged on the motor shaft of the stirring motor. The water pump is a relatively common fluid power unit, which can pump cold water from the water tank into the cold water tube and hence forms the circulation of water. The stirring motor stirs water in the water tank through the stirring blades, so as to avoid the freezing of the water.

In the water cooled draft beer machine, a partition is fixed to the inside of the cabinet. The outside of the partition forms the cold storage chamber, and the inside of the partition and the cabinet form a closed space. The water tank is arranged inside the closed space. The refrigeration box is flat. One side of the refrigeration box is fixed to the outer side face of the partition, while the air outlet and air inlet are set up on the other side face of the refrigeration box. The ambient temperature around the water tank is fairly low, so part of the cooling capacity will be transferred to the partition, and hence the cooling capacity will be directly transferred to the cold storage chamber. The refrigeration box is opposite the water tank. The water tank is flat and has a fairly large contact area with the partition, so the refrigeration box will also be affected by the refrigeration of the water tank, so as to improve the refrigeration effect to the refrigeration box and the air in the cold storage chamber.

In the water cooled draft beer machine, a beer tower is connected to the top of the cabinet, and the beer tap is connected to the upper end of the beer tower. The beer pipe passes through the beer tower and connects the beer tap. The cold water tube enters into the beer tower from the lower end of the beer tower, folds and then extends from the lower end of the beer tower. The section of the cold water tube entering into the beer tower abuts the beer pipe, while the cold water tube extends from the beer tower and coils inside the refrigeration box. The cold water tube has a relatively low temperature, folds into two segments in the beer tower, and adheres to the beer pipe. It can refrigerate the beer pipe, hence fully exerts the refrigeration effect of the cold water tube, and further improves the refrigeration effect to beer.

In the water cooled draft beer machine, the inlet end of the cold water tube is the end which coils inside the refrigeration box, or the inlet end of the cold water tube is the end which enters into the beer tower. Namely, the cold water entering the cold water tube can first pass by the beer tower and then pass by the refrigeration box. Of course, a reverse design is also applicable.

In the water cooled draft beer machine, the fan comprises a shaft rotatably connected to the inside of the refrigeration box. The air inlet and the air outlet are both in a long stripped shape, and the lengthwise direction of both of the air inlet and the air outlet are along the transversal direction of the refrigeration box. The lengthwise direction of the shaft is the same as the lengthwise direction of the air outlet, and the shaft is opposite the air outlet. There are several blades on the outer wall of the shaft, and one end of the shaft is connected to the drive motor. The air inlet and the air outlet are both in a long stripped shape, allowing the air in the refrigeration box to be able to cover the upper part of the cold storage chamber in the direction of width, when blown into the cold storage chamber. The length of the refrigeration section can be fully utilized when the air enters the refrigeration box, which improves the refrigeration effect. The shaft is directly opposite the air outlet. When it rotates, the air is pushed out of the air outlet by the blades.

In the water cooled draft beer machine, two plate shaped connecting brackets are fixed to the inside of the refrigeration box. Two ends of the shaft are connected to the two connecting brackets through bearings respectively, and the drive motor is fixed to one of the connecting brackets. The connection and location of the shaft and the drive motor are achieved by the two connecting brackets. The structure is simple and compact.

In the water cooled draft beer machine, the cold water tube bends and coils in the refrigeration box, forming several refrigeration sections in a strip shape and parallel to each other. These refrigeration sections are arranged in the vertical direction, and in two columns. Two ends of the refrigeration sections extend in the transversal direction, to the two edges of the refrigeration box respectively. The cold water needs to pass through several refrigeration sections. The refrigeration sections are arranged in a successive and parallel manner, and have a long running path inside the refrigeration box, so it has a fairly good refrigeration effect to the air in the refrigeration box.

In the water cooled draft beer machine, the air inlet is opposite the lower refrigeration sections or below the lower refrigeration sections, and the air outlet is opposite the upper refrigeration section or above the upper refrigeration sections. The air is blown from the upper part of refrigeration box into the cold storage chamber, and then returns to the refrigeration box from the lower part of the refrigeration box. This makes the air flow from top to bottom in the cold storage chamber, and flow from bottom to top in the refrigeration box, forming an orderly circulative air flow. Also, the orderly air flow can successively pass through several refrigeration sections, fully exerts the refrigeration effect of every refrigeration section, ensures that the cold storage chamber maintains a fairly low ambient temperature, and improves the refrigeration effect to beer.

Compared to the prior art, one embodiment of the present water cooled draft beer machine has the following advantages:

1. Since the cool air circulates between the refrigeration box and the cold storage chamber, the cold storage chamber has a fairly low ambient temperature and it refrigerates the whole cask. That means that the beer in the cask has been pre-cooled before it is pressed out, and then it is water cooled again by the water tank during the discharge process, so that the refrigeration effect to the beer is improved.

2. Since the cold water needs to pass through several refrigeration sections after entering the cold water tube from the inlet end, and the refrigeration sections are arranged in a successive and parallel manner, it has a long running path inside the refrigeration box, so it has a fairly good refrigeration effect to the air in the refrigeration box.

3. Since the cold water tube enters the beer tower and adheres to the beer pipe, it can refrigerate the beer pipe in the beer tower, hence fully exerts the refrigeration effect of the cold water tube, and further improves the refrigeration effect to beer.

4. Since the air in the refrigeration box is refrigerated by the cold water in the water tank, the cooling capacity of the cold water in the water tank will be fully utilized.

DETAILED DESCRIPTION OF THE INVENTION

Figure 1:
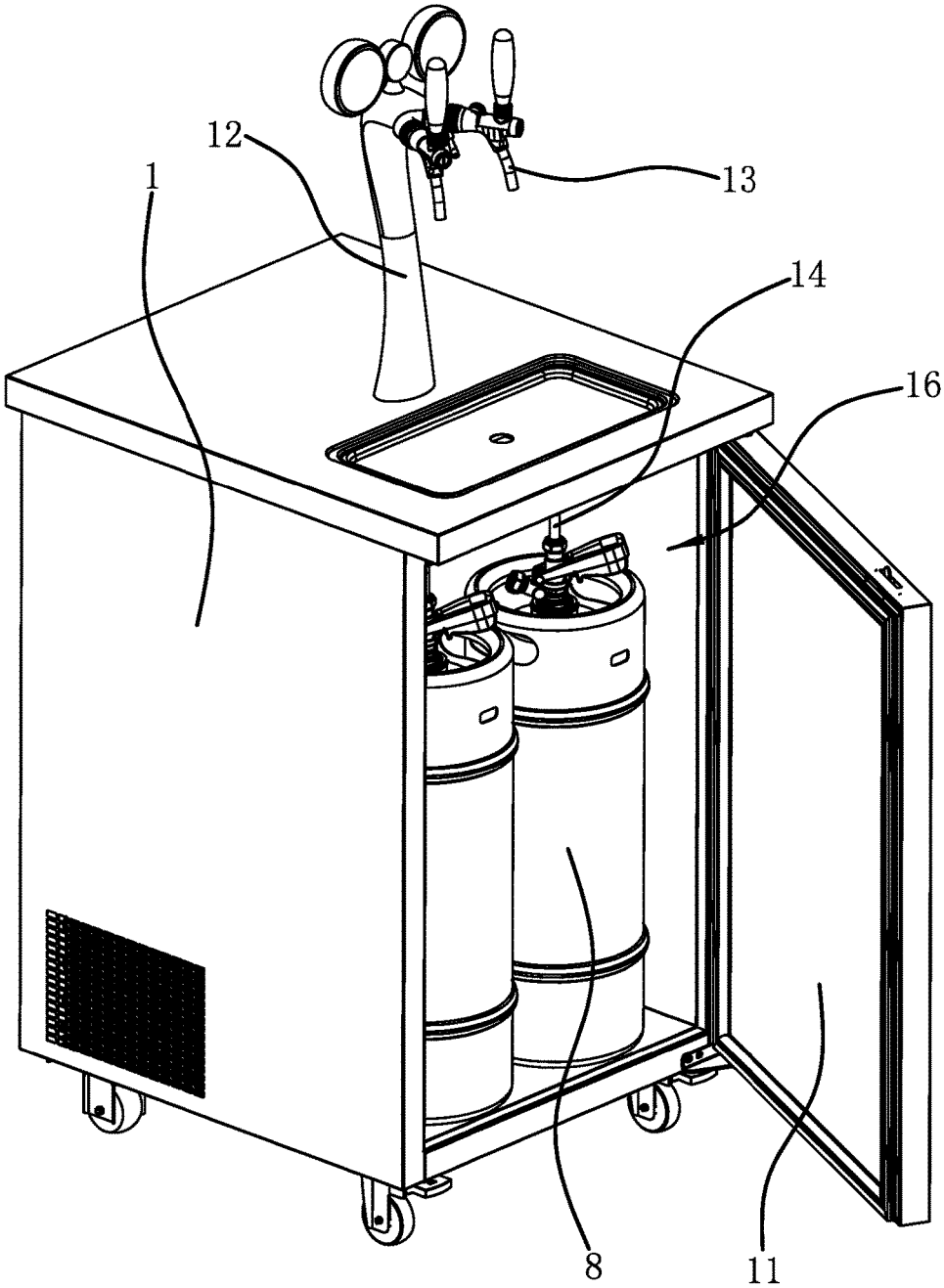
FIG. 1 is the perspective view of one embodiment of the water cooled draft beer machine with the casks in place.
Figure 2:
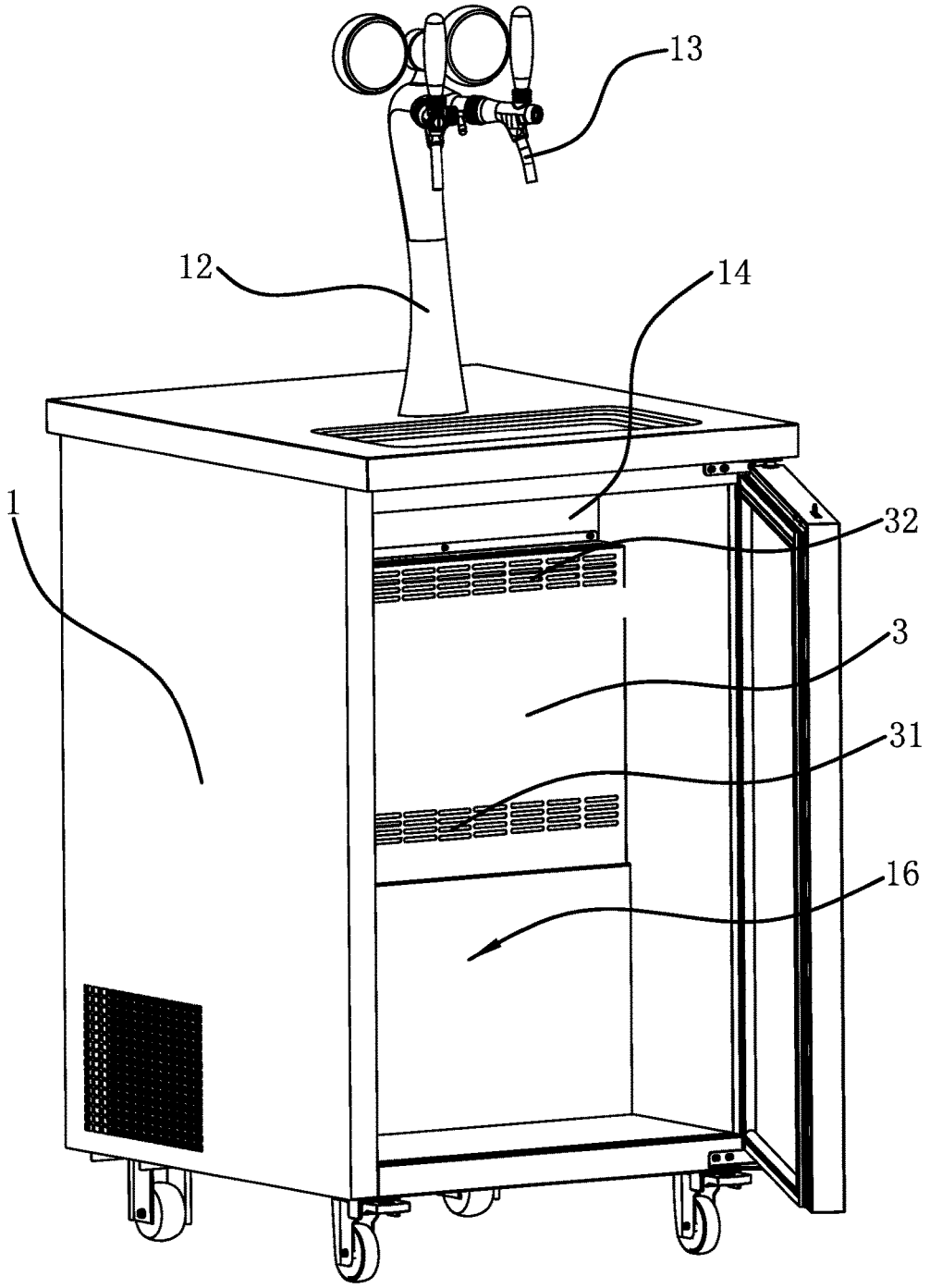
FIG. 2 is the perspective view of one embodiment of the water cooled draft beer machine.
Figure 3:
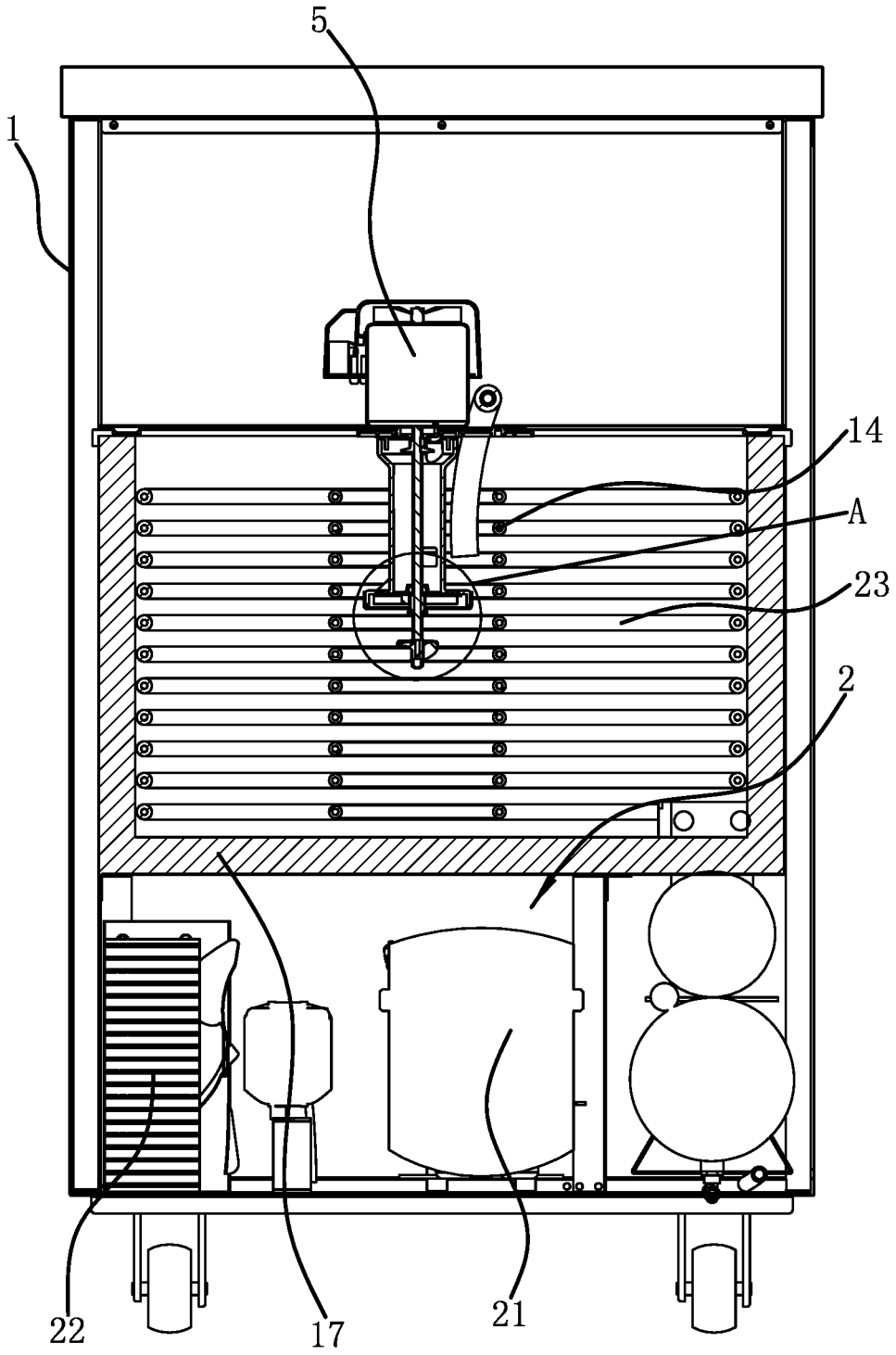
FIG. 3 is the sectional view of one embodiment of the water cooled draft beer machine.
Figure 4:
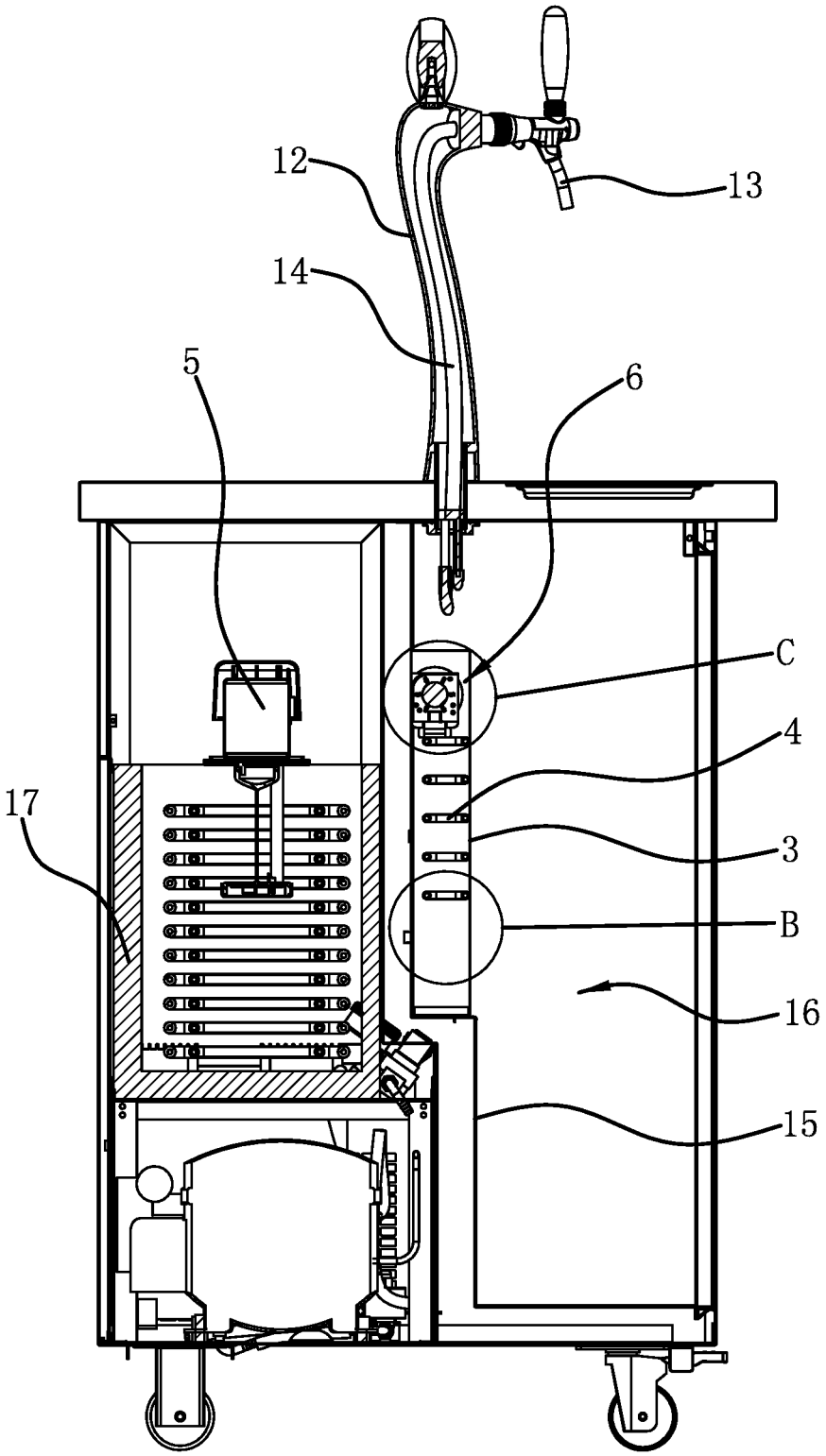
FIG. 4 is the sectional view of one embodiment of the water cooled draft beer machine from another perspective.

The embodiments of this invention will be described below and the technical solutions of the invention will be further illustrated in connection with the accompanying figures. However, the present invention shall not be limited to these embodiments.

First Embodiment

As shown in FIG. 1, FIG. 2, FIG. 3, and FIG. 4, a water cooled draft beer machine comprises a cabinet (1). A door (11) is hinged to one side of the cabinet (1), and a beer tap (13) is connected to the top of the cabinet (1). Inside the cabinet (1), there is a beer pipe (14) used to connect to the cask (8), and the outlet end of the beer pipe (14) is connected to the beer tap (13). A partition (15) is fixed to the inside of the cabinet (1), and the partition (15) is opposite the door (11). The outside of the partition (15) forms a cold storage chamber (16). The cold storage chamber (16) is used to hold the cask (8), and the inlet end of the beer pipe (14) is connected to the cask (8). The inside of the partition (15) and the cabinet (1) form a closed space. The water tank (17) is fixed to the inside of the closed space, and the water tank (17) is located inside the partition (15). A refrigeration circuit (2) is arranged inside the cabinet (1), and the refrigeration circuit (2) includes a compressor (21), a condenser (22) and refrigeration tubes (23). The refrigeration tubes (23) coil in the water tank (17). When the compressor (21) is in operation, the cooling medium in the refrigeration tubes (23) circulates, and refrigerates water in the water tank (17). The beer pipe (14) coils in the water tank (17), so beer needs to pass by the water tank (17) first, and hence the refrigeration to beer is achieved. A refrigeration box (3) is arranged in the cold storage chamber (16), and the refrigeration box (3) is fixed to the partition (15). The cold water tube (4) coils inside the refrigeration box (3). The inlet end and the outlet end of the cold water tube (4) are both connected to the water tank (17). A stirring motor (5) is connected to the water tank (17), and power generated by the stirring motor (5) can drive water in the water tank (17) to circulate in the cold water tube (4) and refrigerate the air in the refrigeration box (3). An air inlet (31) and an air outlet (32) are set up on the refrigeration box (3), and both of the air inlet (31) and the air outlet (32) are connected to the cold storage chamber (16). A fan (6) is arranged inside the refrigeration box (3), and the fan (6) can drive air to circulate between the refrigeration box (3) and the cold storage chamber (16).

Figure 5:
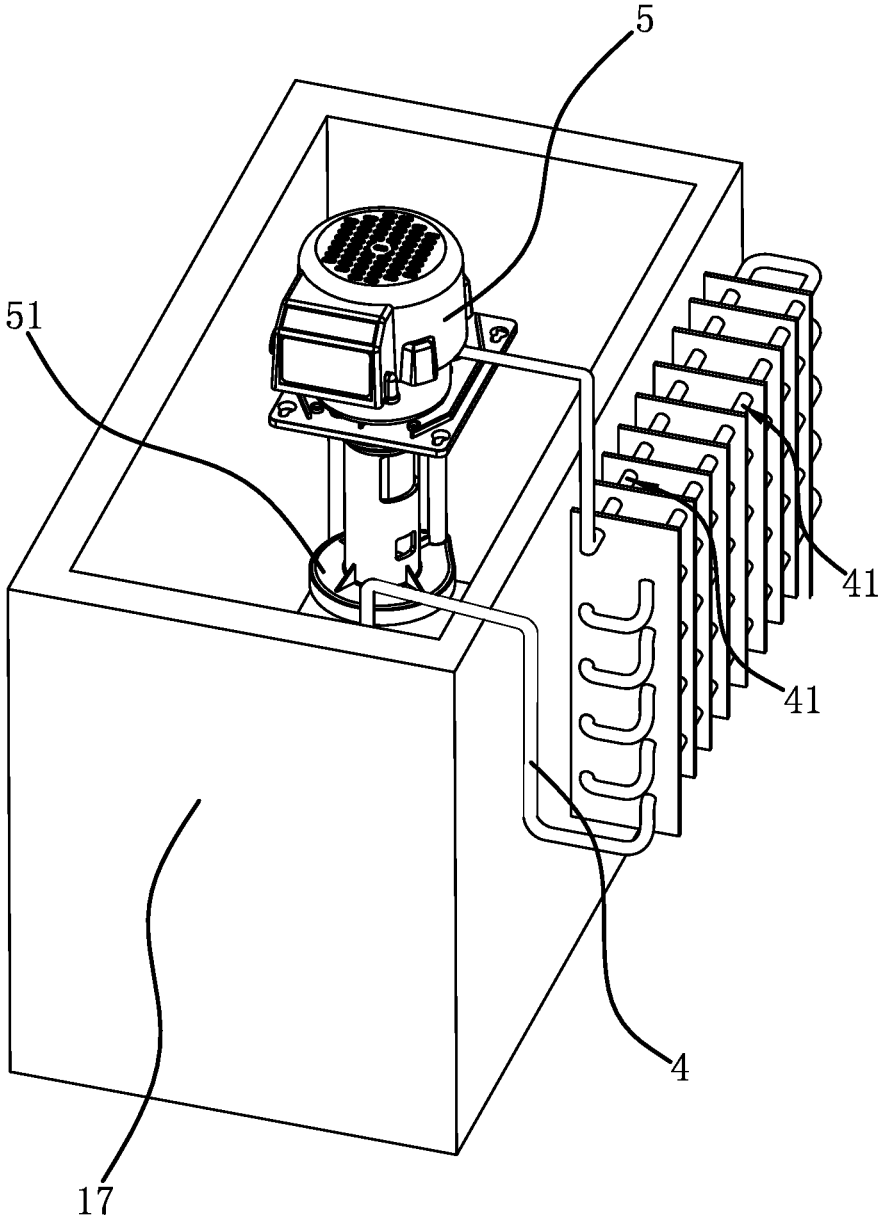
FIG. 5 is the perspective view of one embodiment of the cold water tube and the water tank.
Figure 6:
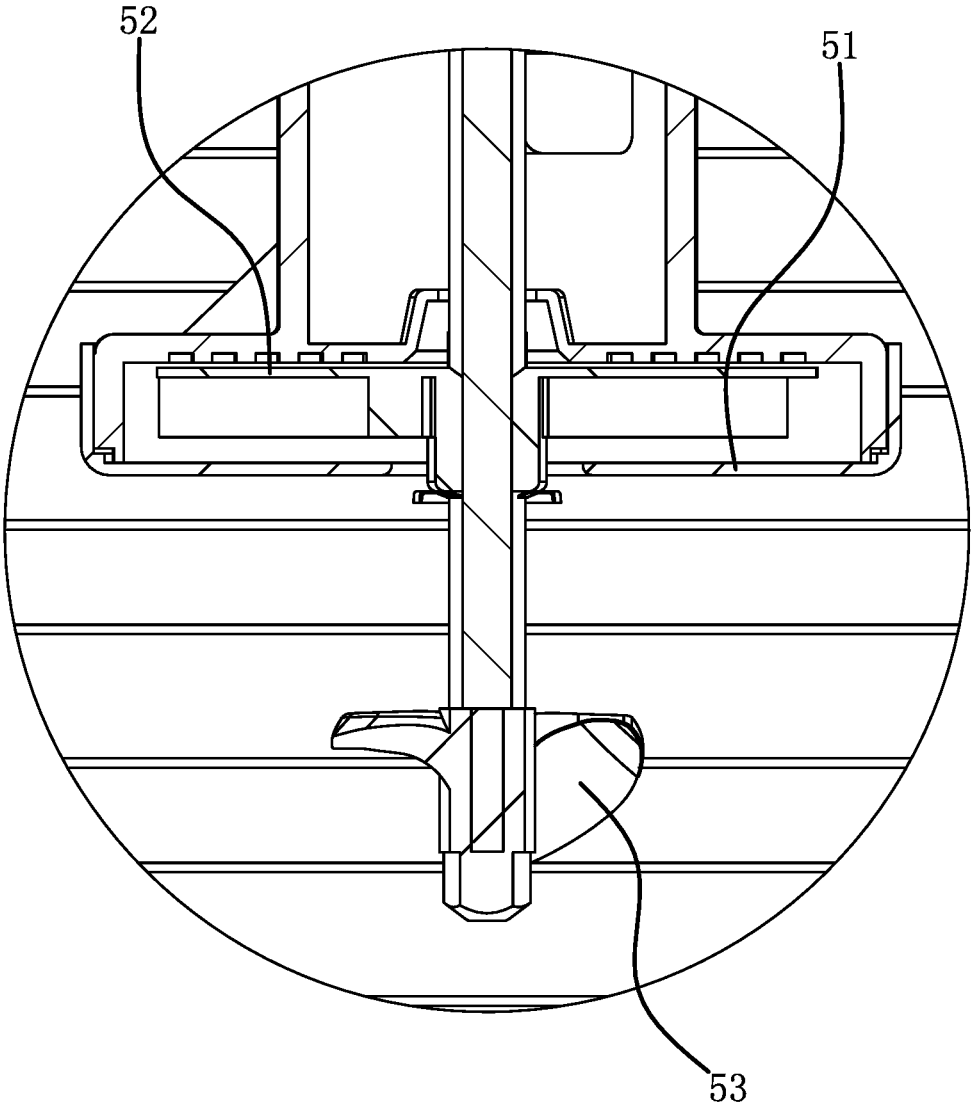
FIG. 6 is the detailed view of place A in FIG. 3.

Specifically, as shown in FIG. 5 and FIG. 6, a volute (51) is fixed to the inside of the water tank (17). A water inlet and a water outlet are set up on the volute (51). The motor shaft of the stirring motor (5) passes through the volute (51), and the extending end is fixed with the stirring blades (53), to stir water in the water tank (17). An impeller (52) is also fixed to the motor shaft of the stirring motor (5). The impeller (52) is located inside the volute (51), and the impeller (52) is opposite the water inlet. The inlet end of the cold water tube (4) is connected to the water outlet of the volute (51). The impeller (52) pumps water from the water tank (17) into the volute (51) and the water circulates in the cold water tube (4). Cold water enters the water tank (17) again after passing by the refrigeration box (3), forming a circulation of water.

Figure 7:
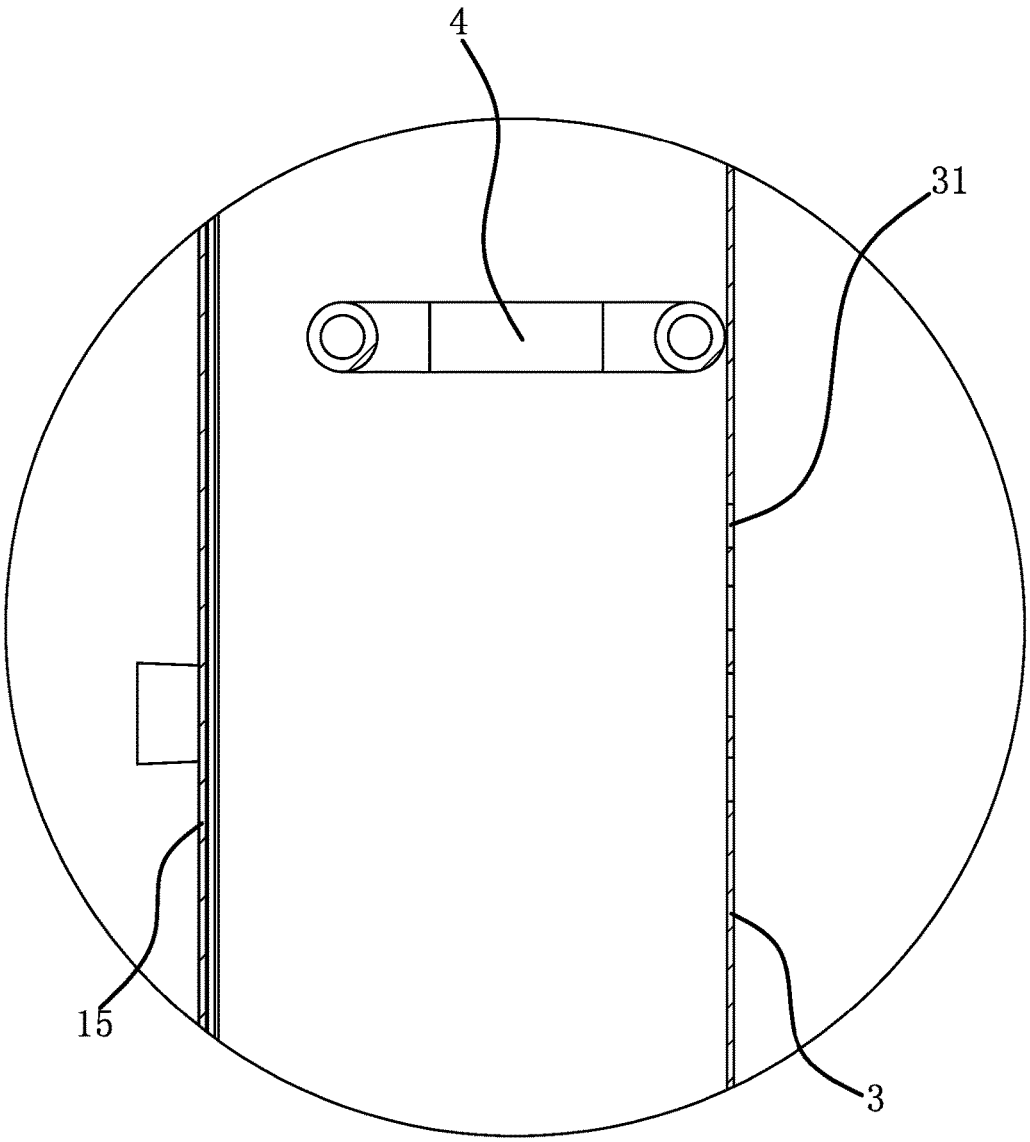
FIG. 7 is the detailed view of place B in FIG. 4.
Figure 8:
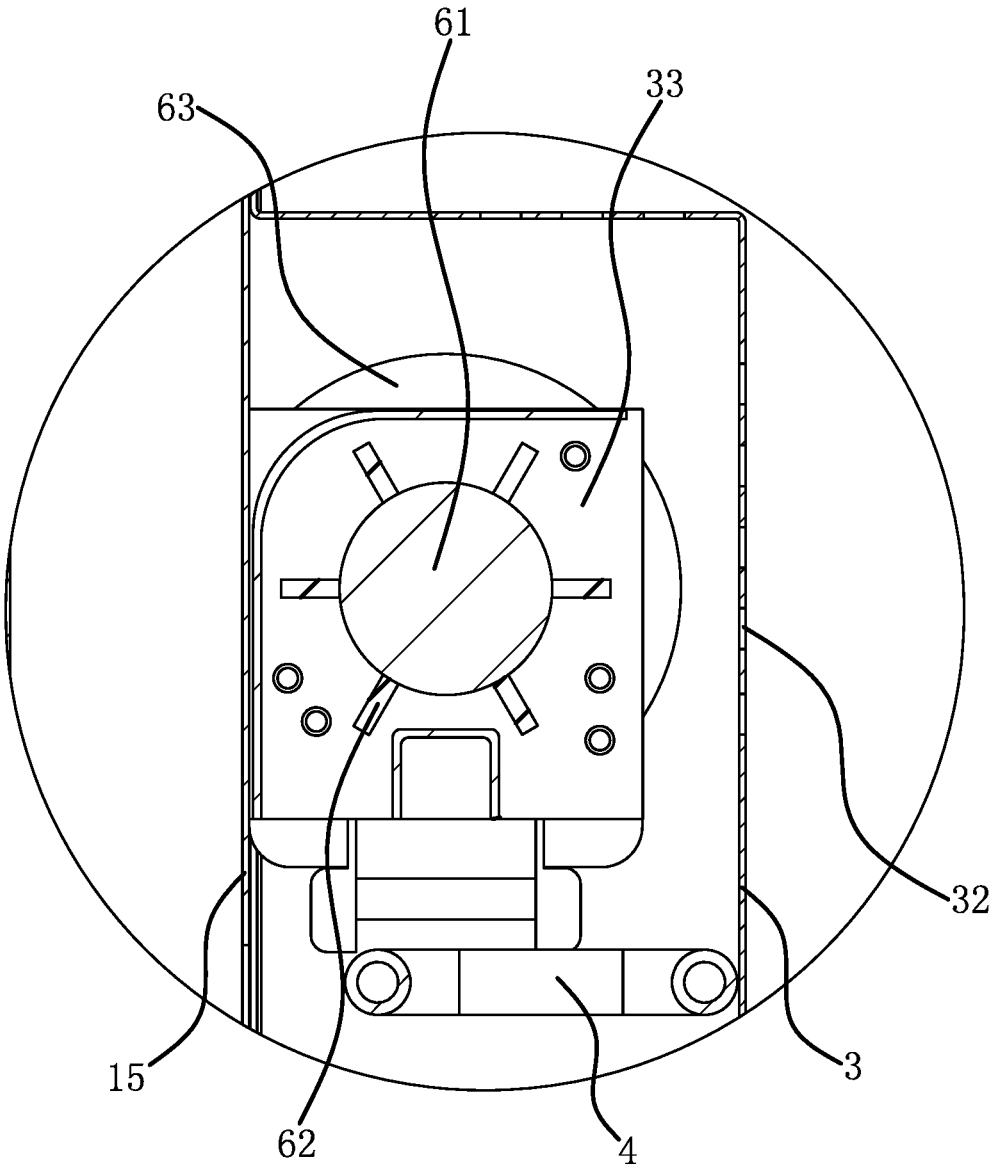
FIG. 8 is the detailed view of place C in FIG. 4.

As shown in FIG. 7 and FIG. 8, the refrigeration box (3) is flat, and the partition (15) is bent into a shape of a step. The bottom of the refrigeration box (3) presses against the step face, and the inner side of the refrigeration box (3) adheres to and is fixed to the outer side of the partition (15). The water tank is located inside the partition (15), so the water tank (17) is opposite the refrigeration box (3). The cold water tube (4) bends and coils in the refrigeration box (3), forming several refrigeration sections (41) in a strip shape. These refrigeration sections (41) are parallel to each other, and these refrigeration sections (41) are arranged in the vertical direction, and in two columns. The top refrigeration section (41) is connected to the water inlet of the cold water tube (4), while the bottom refrigeration section (41) is connected to the water outlet of the cold water tube (4). Two ends of the refrigeration sections (41) extend in the transversal direction, to the two edges of the refrigeration box (3) respectively. The air inlet (31) and the air outlet (32) are both in a long stripped shape, and the lengthwise direction of both of the air inlet (31) and the air outlet (32) are along the transversal direction of the refrigeration box (3). The air outlet (32) is located in the upper part of the outer side wall of the refrigeration box (3) and the air outlet (32) is above the upper refrigeration sections (41). The air inlet (31) is located in the lower part of the outer side wall of the refrigeration box (3) and the air inlet (31) is below the lower refrigeration sections (41). Of course, during the real machining process, the air inlet (31) may be opposite the lower refrigeration sections (41), and the air outlet (32) may be opposite the upper refrigeration sections (41).

Figure 9:
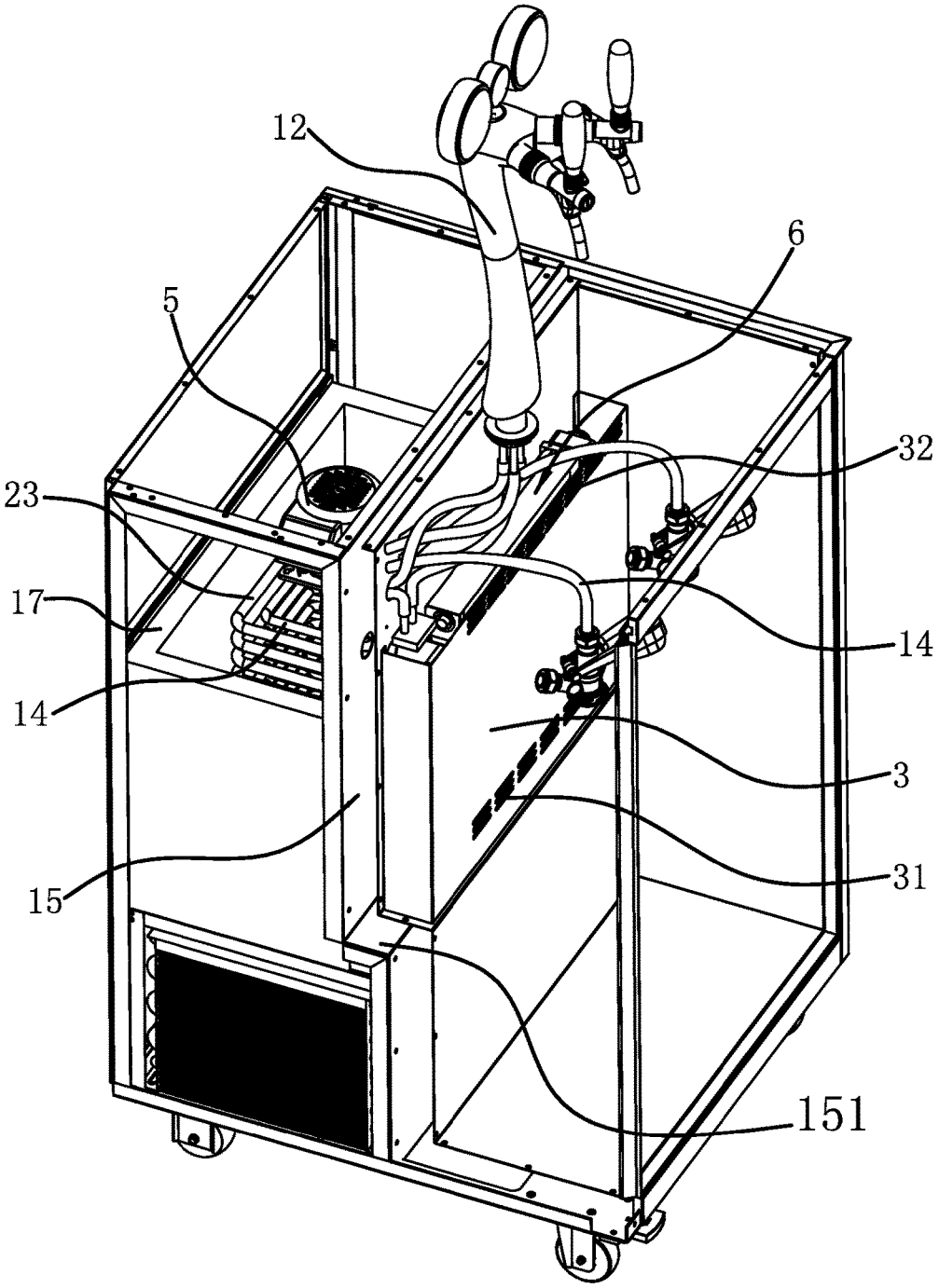
FIG. 9 is the perspective view of the inside of one embodiment of the water cooled draft beer machine.

As shown in FIG. 8 and FIG. 9, the fan (6) comprises a shaft (61). There are long stripped blades (62) on the outer wall of the shaft (61). The blades (62) are arranged in the circumferential direction, and the lengthwise direction of the blades (62) is the same as that of the shaft (61). Two plate shaped connecting brackets (33) are fixed to the inside of the refrigeration box (3). Two ends of the shaft (61) are connected to the two connecting brackets (33) through bearings respectively. The lengthwise direction of the shaft (61) is the same as the lengthwise direction of the air outlet (32), and the shaft (61) is opposite the air outlet (32). A drive motor (63) is fixed to one of the connecting brackets (33), and the drive motor (63) is fixed to the shaft (61).

Second Embodiment

Figure 10:
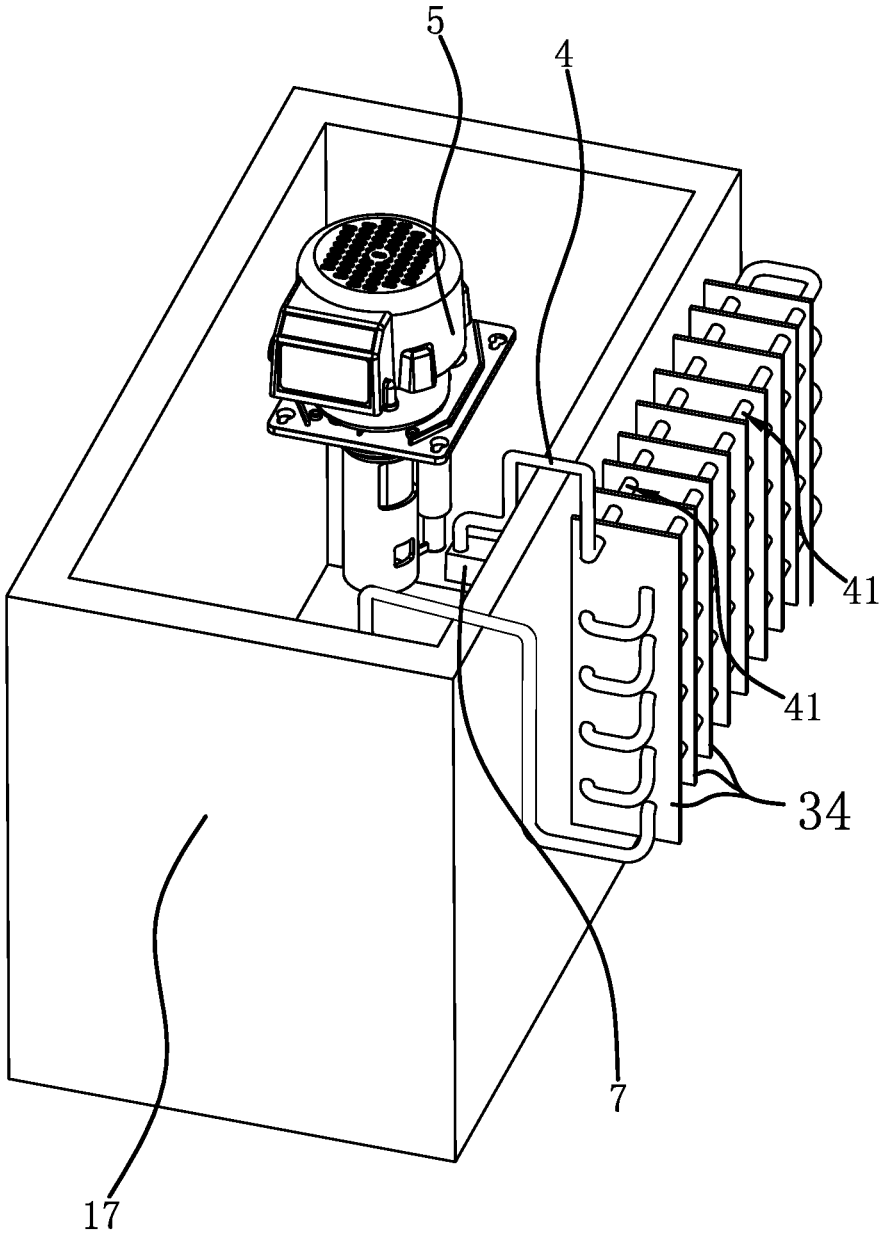
FIG. 10 is the perspective view of the cold water tube and the water tank of a second embodiment.

The structure of the water cooled draft beer machine is basically the same as that of the First Embodiment. The differences are shown in FIG. 10:

A water pump (7) is fixed to the inside of the water tank (17), and the cold water tube (4) is connected to the water pump (7). A water pump (7) is a relatively common fluid power unit, which can pump cold water from the water tank (17) into the cold water tube (4) and hence forms the circulation of water.

Third Embodiment

Figure 11:
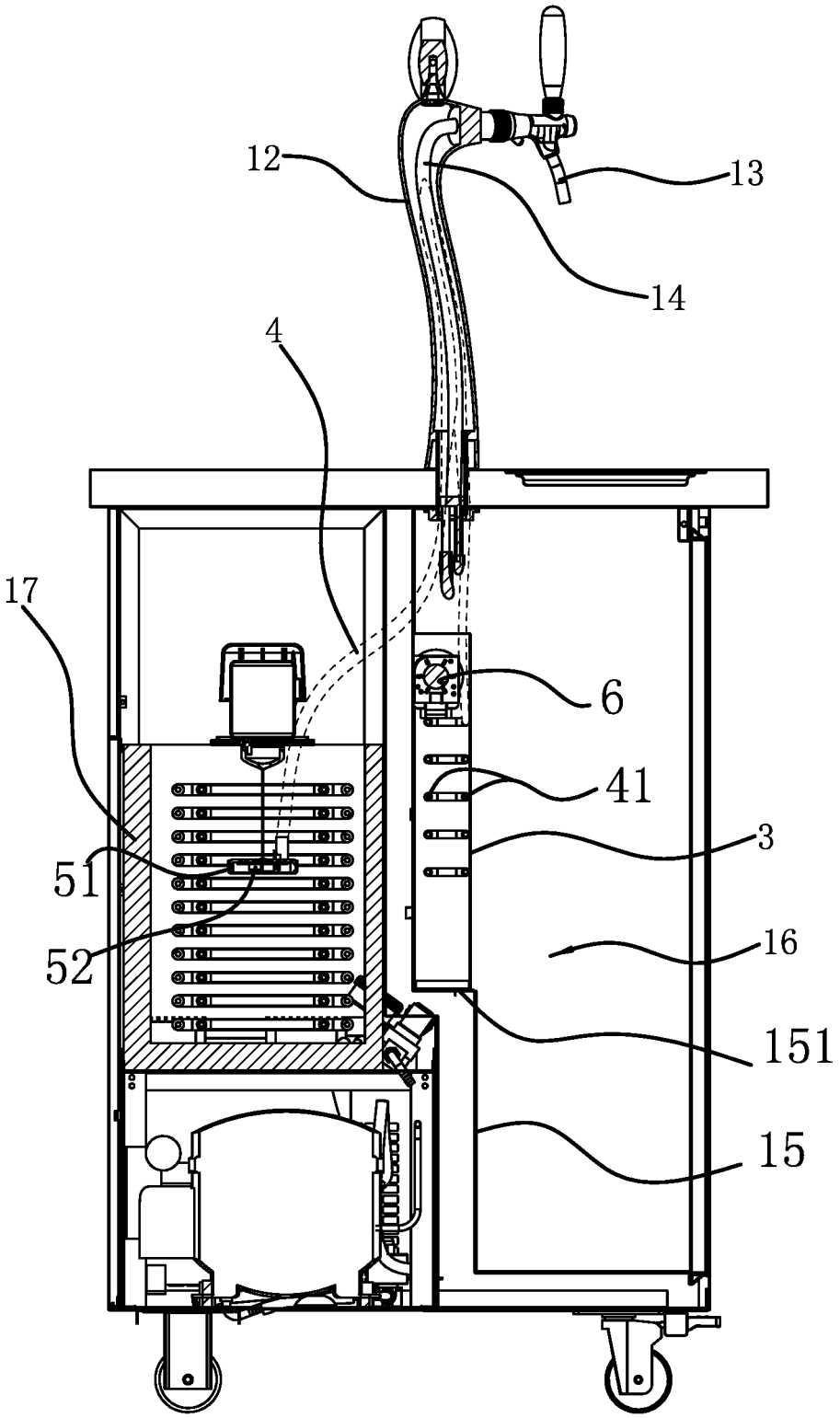
FIG. 11 is the sectional view of the water cooled draft beer machine of a third embodiment.

The structure of the water cooled draft beer machine is basically the same as that of the First Embodiment. The differences are shown in FIG. 11:

A beer tower (12) is connected to the top of the cabinet (1), and the beer tap (13) is connected to the upper end of the beer tower (12). The beer pipe (14) passes through the beer tower (12) and connects the beer tap (13). A section of the inlet end of the cold water tube (4) enters the beer tower (12) from the lower end of the beer tower (12), folds and then extends from the lower end of the beer tower (12). The section of the cold water tube (4) entering the beer tower (12) abuts the beer pipe (14). The cold water tube (4) has a relatively low temperature and water from the water tank (17) and just entering the cold water tube (4) has a relatively low temperature, so the cold water tube (4) can also refrigerate the beer pipe (14) inside the beer tower (12), and hence the refrigeration effect to beer is further improved.

Fourth Embodiment

Figure 12:
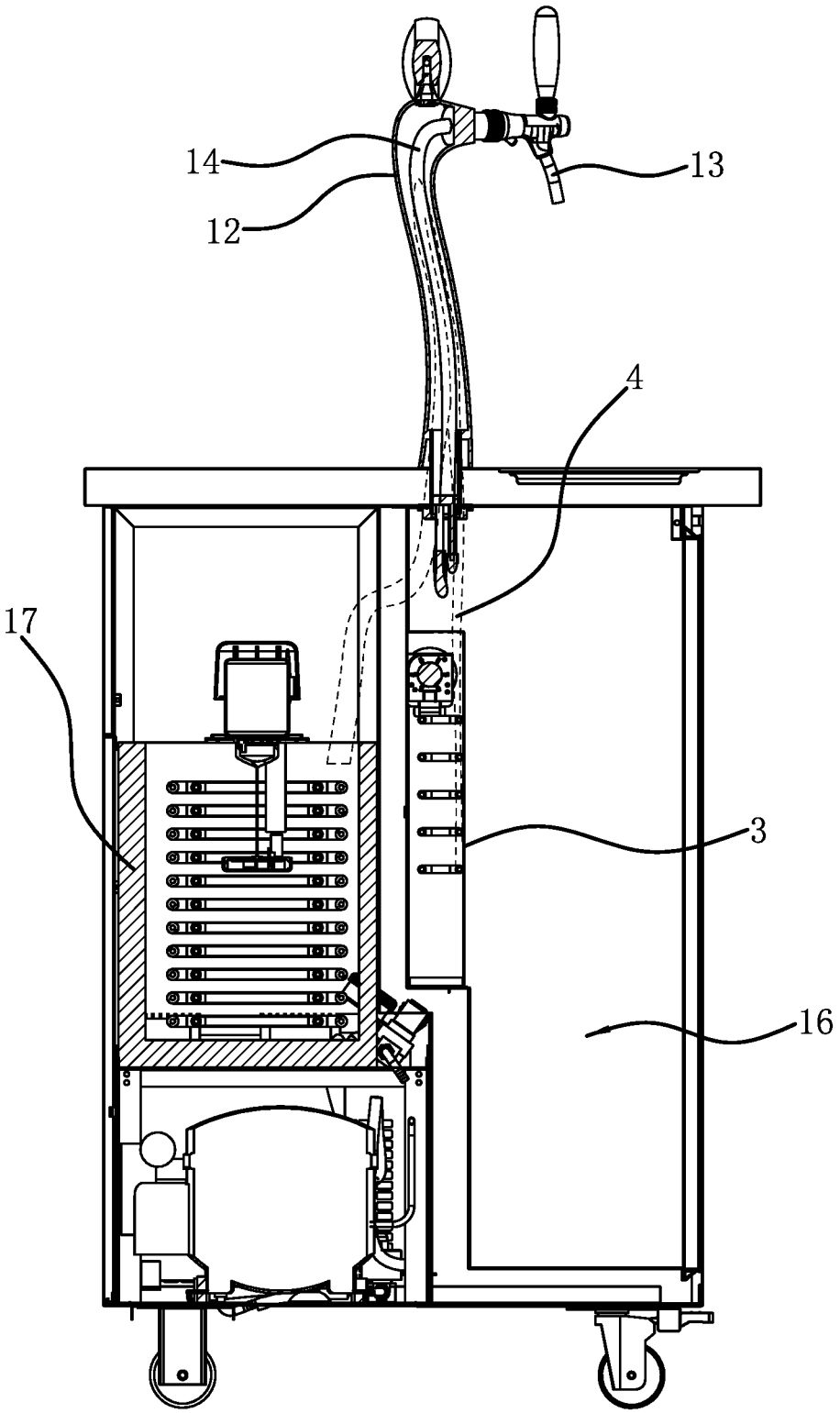
FIG. 12 is the sectional view of the water cooled draft beer machine of a fourth embodiment.

The structure of the water cooled draft beer machine is basically the same as that of the First Embodiment. The differences are shown in FIG. 12:

A beer tower (12) is connected to the top of the cabinet (1), and the beer tap (13) is connected to the upper end of the beer tower (12). The beer pipe (14) passes through the beer tower (12) and connects the beer tap (13). A section of the cold water tube (4) enters the beer tower (12) from the lower end of the beer tower (12), folds and then extends from the lower end of the beer tower (12). The section of the cold water tube (4) entering the beer tower (12) abuts the beer pipe (14). Water in the cold water tube (4) still has some cooling capacity after passing by the refrigeration box (3), and it can refrigerate the beer pipe inside the beer tower (12) before entering the water tank (17). Hence, the refrigeration effect of the cold water tube (4) is fully exerted, and the refrigeration effect to beer is further improved.

The description of the preferred embodiments thereof serves only as an illustration of the spirit of the invention. It will be understood by those skilled in the art that various changes or supplements in form and details may be made therein without departing from the spirit and scope of the invention as defined by the appended claims.

Although the terms of Cabinet (1), Door (11), Beer tower (12), etc. are often used herein, it does not exclude the possibility to use any other terms. Using such terms is only to describe or explain the nature of the present invention more conveniently. Any additional restrictions are contrary to the spirit of the present invention.

LIST OF REFERENCE NUMERALS

1 Cabinet
11 Door
12 Beer Tower
13 Beer Tap
14 Beer Pipe
15 Partition
16 Cold Storage Chamber
17 Water Tank
2 Refrigeration Circuit
21 Compressor
22 Condenser
23 Refrigeration Tube
3 Refrigeration Box
31 Air Inlet
32 Air Outlet
33 Connecting Bracket
4 Cold Water Tube
41 Refrigeration Section
5 Stirring Motor
51 Volute
52 Impeller
53 Stirring Blade
6 Fan
61 Shaft
62 Blade
63 Drive Motor
7 Water Pump
8 Cask

What is claimed is:

1. A water cooled draft beer machine, comprising:

a cabinet (1);

a refrigeration circuit (2) inside the cabinet (1), the refrigeration circuit (2) including a compressor (21), a condenser (22), and refrigeration tubes (23);

a water tank (17) arranged inside the cabinet (1), and the refrigeration tubes (23) coiled inside the water tank (17);

a cold storage chamber (16)inside the cabinet (1), the cold storage chamber (16)used to hold a cask (8);

a beer pipe (14) arranged inside the cabinet (1) to connect to the cask (8), the beer pipe (14) coiled inside the water tank (17);

a beer tap (13) connected to an outside of the cabinet (1);

an outlet end of the beer pipe (14) connected to the beer tap (13);

a refrigeration box (3) arranged in the cold storage chamber (16);

a cold water tube (4) coiled inside the refrigeration box (3);

an inlet end and an outlet end of the cold water tube (4), both the inlet end and the outlet end of the cold water tube (4) are connected to the water tank (17);

a power mechanism arranged in the cabinet (1) capable of driving water from the water tank (17) into the cold water tube (4);

an air inlet (31) and an air outlet (32) on the refrigeration box (3), both the air inlet (31) and the air outlet (32) are connected to the cold storage chamber (16); and a fan (6) arranged inside the refrigeration box (3) to drive air to circulate between the refrigeration box (3) and the cold storage chamber (16);

wherein the cold water tube (4) bends and coils in the refrigeration box (3), forming several horizontal refrigeration sections (41) in a strip shape;

wherein the refrigeration sections (41) are parallel to each other and the refrigeration sections (41) are arranged in a vertical direction and in two columns; and wherein the fan (6) is located above two columns of the refrigeration sections (41).

2. The water cooled draft beer machine as claimed in claim 1 wherein the power mechanism comprises a stirring motor (5) with an impeller (52) and a volute (51), the impeller (52) is located in the volute (51), and the inlet end of the cold water tube (4) is connected to the volute (51).

3. The water cooled draft beer machine as claimed in claim 2, further comprising:

a partition (15) fixed to an inside of the cabinet (1);

wherein an outside of the partition (15) forms the cold storage chamber (16);

wherein an inside of the partition (15) and the cabinet (1) form a closed space;

wherein the water tank (17) is arranged inside the closed space;

wherein the refrigeration box (3) is flat; and wherein a first side of the refrigeration box (3) is fixed to an outer side face of the partition (15), while the air inlet (31) and the air outlet (32) are on a second side of the refrigeration box (3).

4. The water cooled draft beer machine as claimed in claim 3, further comprising:

a beer tower (12) connected to a top of the cabinet (1);

wherein the beer tap (13) is connected to an upper end of the beer tower (12);

wherein the beer pipe (14) passes through the beer tower (12) and connects the beer tap (13);

wherein the cold water tube (4) enters the beer tower (12) from a lower end of the beer tower (12), folds, and then extends from the lower end of the beer tower (12); and wherein a section of the cold water tube (4) entering the beer tower (12) abuts the beer pipe (14); and wherein the cold water tube (4) extends from the beer tower (12) and coils inside the refrigeration box (3).

5. The water cooled draft beer machine as claimed in claim 3 wherein the fan (6) comprises a shaft (61) rotatably connected to an inside of the refrigeration box (3);

wherein the air inlet (31) and the air outlet (32) are both in a long stripped shape;

wherein a lengthwise direction of the air inlet (31) and a lengthwise direction of the air outlet (32) are both along a transversal direction of the refrigeration box (3);

wherein a lengthwise direction of the shaft (61) is the same as the lengthwise direction of the air outlet (32);

wherein the shaft (61) is opposite the air outlet (32);

wherein there are several blades (62) on an outer wall of the shaft (61); and wherein one end of the shaft (61) is connected to the drive motor (63).

6. The water cooled draft beer machine as claimed in claim 5 wherein two plate shaped connecting brackets (33) are fixed to the inside of the refrigeration box (3);

wherein two ends of the shaft (61) are connected to the two connecting brackets (33) through bearings, respectively; and wherein the drive motor (63) is fixed to one of the connecting brackets (33).

7. The water cooled draft beer machine as claimed in claim 2 wherein the fan (6) comprises a shaft (61) rotatably connected to an inside of the refrigeration box (3);

wherein the air inlet (31) and the air outlet (32) are both in a long stripped shape;

wherein a lengthwise direction of the air inlet (31) and a lengthwise direction of the air outlet (32) are both along a transversal direction of the refrigeration box (3);

wherein a lengthwise direction of the shaft (61) is the same as the lengthwise direction of the air outlet (32);

wherein the shaft (61) is opposite the air outlet (32);

wherein there are several blades (62) on an outer wall of the shaft (61); and wherein one end of the shaft (61) is connected to the drive motor (63).

8. The water cooled draft beer machine as claimed in claim 7 wherein two plate shaped connecting brackets (33) are fixed to the inside of the refrigeration box (3);

wherein two ends of the shaft (61) are connected to the two connecting brackets (33) through bearings, respectively; and wherein the drive motor (63) is fixed to one of the connecting brackets (33).

9. The water cooled draft beer machine as claimed in claim 2 wherein two ends of the refrigeration sections (41) extend in a transversal direction, to two edges of the refrigeration box (3), respectively.

10. The water cooled draft beer machine as claimed in claim 9 wherein the air inlet (31) is opposite the lower refrigeration sections (41) or below the lower refrigeration sections (41), and the air outlet (32) is opposite the upper refrigeration section (41) or above the upper refrigeration sections (41).

11. The water cooled draft beer machine as claimed in claim 2, further comprising:

a beer tower (12) connected to a top of the cabinet (1);

wherein the beer tap (13) is connected to an upper end of the beer tower (12);

wherein the beer pipe (14) passes through the beer tower (12) and connects the beer tap (13);

wherein the cold water tube (4) enters the beer tower (12) from a lower end of the beer tower (12), folds, and then extends from the lower end of the beer tower (12); and wherein a section of the cold water tube (4) entering the beer tower (12) abuts the beer pipe (14); and wherein the cold water tube (4) extends from the beer tower (12) and coils inside the refrigeration box (3).

12. The water cooled draft beer machine as claimed in claim 1 wherein the power mechanism comprises a water pump (7) fixed to an inside of the water tank (17); and wherein the cold water tube (4) is connected to the water pump (7).

13. The water cooled draft beer machine as claimed in claim 12, further comprising:

a beer tower (12) connected to a top of the cabinet (1);

wherein the beer tap (13) is connected to an upper end of the beer tower (12);

wherein the beer pipe (14) passes through the beer tower (12) and connects the beer tap (13);

wherein the cold water tube (4) enters the beer tower (12) from a lower end of the beer tower (12), folds, and then extends from the lower end of the beer tower (12); and wherein a section of the cold water tube (4) entering the beer tower (12) abuts the beer pipe (14); and wherein the cold water tube (4) extends from the beer tower (12) and coils inside the refrigeration box.

14. The water cooled draft beer machine as claimed in claim 12 wherein the fan (6) comprises a shaft (61) rotatably connected to an inside of the refrigeration box (3);

wherein the air inlet (31) and the air outlet (32) are both in a long stripped shape;

wherein a lengthwise direction of the air inlet (31) and a lengthwise direction of the air outlet (32) are both along a transversal direction of the refrigeration box (3);

wherein a lengthwise direction of the shaft (61) is the same as the lengthwise direction of the air outlet (32);

wherein the shaft (61) is opposite the air outlet (32);

wherein there are several blades (62) on an outer wall of the shaft (61); and wherein one end of the shaft (61) is connected to the drive motor (63).

15. The water cooled draft beer machine as claimed in claim 14 wherein two plate shaped connecting brackets (33) are fixed to the inside of the refrigeration box (3);

wherein two ends of the shaft (61) are connected to the two connecting brackets (33) through bearings, respectively; and wherein the drive motor (63) is fixed to one of the connecting brackets (33).

16. The water cooled draft beer machine as claimed in claim 1, further comprising:

a beer tower (12) connected to a top of the cabinet (1);

wherein the beer tap (13) is connected to an upper end of the beer tower (12);

wherein the beer pipe (14) passes through the beer tower (12) and connects the beer tap (13);

wherein the cold water tube (4) enters the beer tower (12) from a lower end of the beer tower (12), folds, and then extends from the lower end of the beer tower (12); and wherein a section of the cold water tube (4) entering the beer tower (12) abuts the beer pipe (14); and wherein the cold water tube (4) extends from the beer tower (12) and coils inside the refrigeration box (3).

17. The water cooled draft beer machine as claimed in claim 16 wherein the inlet end of the cold water tube (4) either coils inside the refrigeration box (3), or enters into the beer tower (12).

18. The water cooled draft beer machine as claimed in claim 1 wherein several plates (34) are arranged in the refrigeration box (3) in the vertical direction and at intervals, the refrigeration sections (41) are secured in the plates (34).

19. The water cooled draft beer machine as claimed in claim 1 wherein a partition (15) fixed to an inside of the cabinet (1) and an outside of the partition (15) forms the cold storage chamber (16);

wherein a step (151) is provided on the outside of the partition (15); and wherein the refrigeration box (3) is located on the step (151).

* * * * *